US008828509B2

(12) United States Patent
Stoeppler

(10) Patent No.: US 8,828,509 B2
(45) Date of Patent: Sep. 9, 2014

(54) PARTY GIFT WREATH APPARATUS AND METHODS

(76) Inventor: Dale Stoeppler, Santa Fe, NM (US)

( * ) Notice: Subject to any disclaimer, the term of this patent is extended or adjusted under 35 U.S.C. 154(b) by 113 days.

(21) Appl. No.: 13/585,737

(22) Filed: Aug. 14, 2012

(65) Prior Publication Data

US 2013/0043364 A1 Feb. 21, 2013

Related U.S. Application Data

(60) Provisional application No. 61/525,163, filed on Aug. 18, 2011.

(51) Int. Cl.
*F16M 11/00* (2006.01)
*A47G 33/00* (2006.01)

(52) U.S. Cl.
CPC ..... *A47G 33/00* (2013.01)
USPC ..... 428/10; 248/317

(58) Field of Classification Search
USPC ..... 248/317, 320, 327, 328; 428/10
See application file for complete search history.

(56) References Cited

U.S. PATENT DOCUMENTS

| | | | | |
|---|---|---|---|---|
| 1,853,305 | A | 4/1932 | Frei, Jr. | |
| D282,649 | S * | 2/1986 | Crinklaw | D11/120 |
| 4,884,350 | A | 12/1989 | Whetstone | |
| 5,110,635 | A | 5/1992 | Creegan | |
| 5,156,893 | A | 10/1992 | Barthe | |
| D340,672 | S | 10/1993 | Adams | |
| D364,523 | S | 11/1995 | Carter | |
| 7,043,875 | B1 | 5/2006 | Neuner | |
| 7,217,446 | B2 | 5/2007 | Moody | |
| 8,137,768 | B1 * | 3/2012 | Chen | 428/10 |
| D692,793 | S | 11/2013 | Stoeppler | |
| 2010/0320337 | A1 * | 12/2010 | Bennett et al. | 248/121 |

FOREIGN PATENT DOCUMENTS

| | | | |
|---|---|---|---|
| JP | 2000325199 | A | 11/2000 |
| KR | 20100120106 | A | 11/2011 |

OTHER PUBLICATIONS

Stock Food, "White Hanging Advent Wreath with Baubles", http://www.stockfood.co.th/image-picture-White-hanging-Advent-wreath-with-baubles-851811.html, Aug. 10, 2011.

Tutorial From A Catch My Party Member—How to Make a Butterfly Mobile, http://blog.catchmyparty.com/2011/04/04/tutorial-from-a-catch-m-party-member-how-to-make-a-butterfly-mobile/, Apr. 4, 2011.

(Continued)

*Primary Examiner* — Steven Marsh

(74) *Attorney, Agent, or Firm* — Franklin & Associates International Inc; Matthew F. Lambrinos

(57) ABSTRACT

A gift wreath apparatus hangs similar or different reusable gift boxes to be filled. In one example, a plurality of hangers is configured for removeably and slidably hanging the reusable gift boxes from the wreath member. A plurality of fasteners are configured for attaching one of the reusable gift boxes in a substantially closed configuration to one of the hangers and for detaching the gift box from the second hanger end while keeping the box closed. The fastener can comprise a hook on the free end of the hanger and a ribbon secured to the lid of the box. The box ribbon is bow tied and the bow tie hung from the hook. The apparatus can be assembled from a kit of parts. A method for assembly can be provided in an instruction manual provided with the kit of parts.

20 Claims, 6 Drawing Sheets

(56) References Cited

OTHER PUBLICATIONS

Christmas Wreath Store, 36" Holiday Wreath Bag with Center Storage, http://www.christmaswreathstore.com/decorations/36-holiday-wreath-bag-with-center-storage/, Jul. 25, 2011.

Anne Kinsey,How to Make a Wreath Made With Boxes, http://www.ehow.com/how_5777639_make-wreath-made-boxes.html, Jun. 21, 2011.

Jack's Dog House, Pit Bull Terrier White Christmas Ornament Hanging Gift Box, http://www.jakesdoghouse.com/pitbull-terrier-white-christmas-ornament-hanging-gift-box.html, Aug. 10, 2011.

Crate and Barrel, Ornament-Photo Chandelie, http://www.crateandbarrel.com/search.aspx?query=Ornament-Photo, downloaded from website on Nov. 10, 2011.

* cited by examiner

PARTY GIFT WREATH APPARATUS AND METHODS

This application claims priority under 35 U.S.C 119(e) to U.S. Provisional patent application No. 61/525,163, entitled "Party Gift Wreath Apparatus and Methods", which was filed on Aug. 18, 2011, the disclosure of which is incorporated herein by reference in its entirety.

TECHNICAL FIELD

The present invention relates to wreaths and, more particularly, to reusable wreath apparatus and associated methods.

BACKGROUND

Typically, a wreath is a ring or wheel of evergreen decorated with candles and flowers. One common type of wreath is the advent wreath which is a Christian tradition symbolizing the occasion of advent.

There is a need for improved wreath apparatus that are reusable and versatile.

SUMMARY

According to one aspect of the present invention, a wreath apparatus is provided. The wreath apparatus can comprise a wreath member for attaching to a support structure; a plurality of reusable gift boxes for filling with at least one gift, a plurality of hangers for hanging the reusable gift boxes from the wreath member; each hanger including a first end for hanging from the wreath member and a second end for hanging one of the reusable gift boxes therefrom; a plurality of fasteners; each fastener being configured for attaching one of the reusable gift boxes in a substantially closed configuration to one of the hanger second ends and for detaching the gift box from the second hanger end; wherein each reusable gift box hanging from the wreath member is detachable from the hanger for filling with at least one gift, or removing a gift stored therein; and wherein the detached reusable gift box is re-hangable from the wreath member in the substantially closed configuration by the fastener.

According to another aspect of the present invention, a kit of parts for assembling a wreath apparatus is provided. The kit of parts can comprise a wreath member for attaching to a support structure; a plurality of reusable gift boxes for filling with at least one gift, a plurality of hangers for hanging the reusable gift boxes from the wreath member; each hanger including a first end for hanging from the wreath member and a second end for hanging one of the reusable gift boxes therefrom; a plurality of fasteners; each fastener being configured for attaching one of the reusable gift boxes in a substantially closed configuration to one of the hanger second ends and for detaching the gift box from the second hanger end; wherein, on assembly, each reusable gift box hanging from the wreath member is detachable from the hanger for filling with at least one gift, or removing a gift stored therein; and wherein the detached reusable gift box is re-hangable from the wreath member in the substantially closed configuration by the fastener.

According to yet another aspect, a method for assembling a wreath apparatus is provided, the wreath apparatus comprising a wreath member for attaching to a support structure, a plurality of reusable gift boxes for filling with at least one gift, a plurality of hangers for hanging the reusable gift boxes from the wreath member, each hanger including a first end for hanging from the wreath member and a second end for hanging one of the reusable gift boxes therefrom, and a plurality of fasteners; each fastener being configured for attaching one of the reusable gift boxes in a substantially closed configuration to one of the hanger second ends and for detaching the gift box from the second hanger end. The method for assembly can comprise attaching the wreath member to the support structure; hanging a first end of each hanger from the wreath member; and utilizing each fastener to hang each reusable gift box from the second end of each hanger whilst holding the gift box closed; utilizing each fastener to remove the gift box from the hanger second end whilst holding the gift box closed.

BRIEF DESCRIPTION OF THE DRAWINGS

In order that the present invention may be more readily understood, reference will now be made to the accompanying drawings, in which.

DETAILED DESCRIPTION

Figure 1:
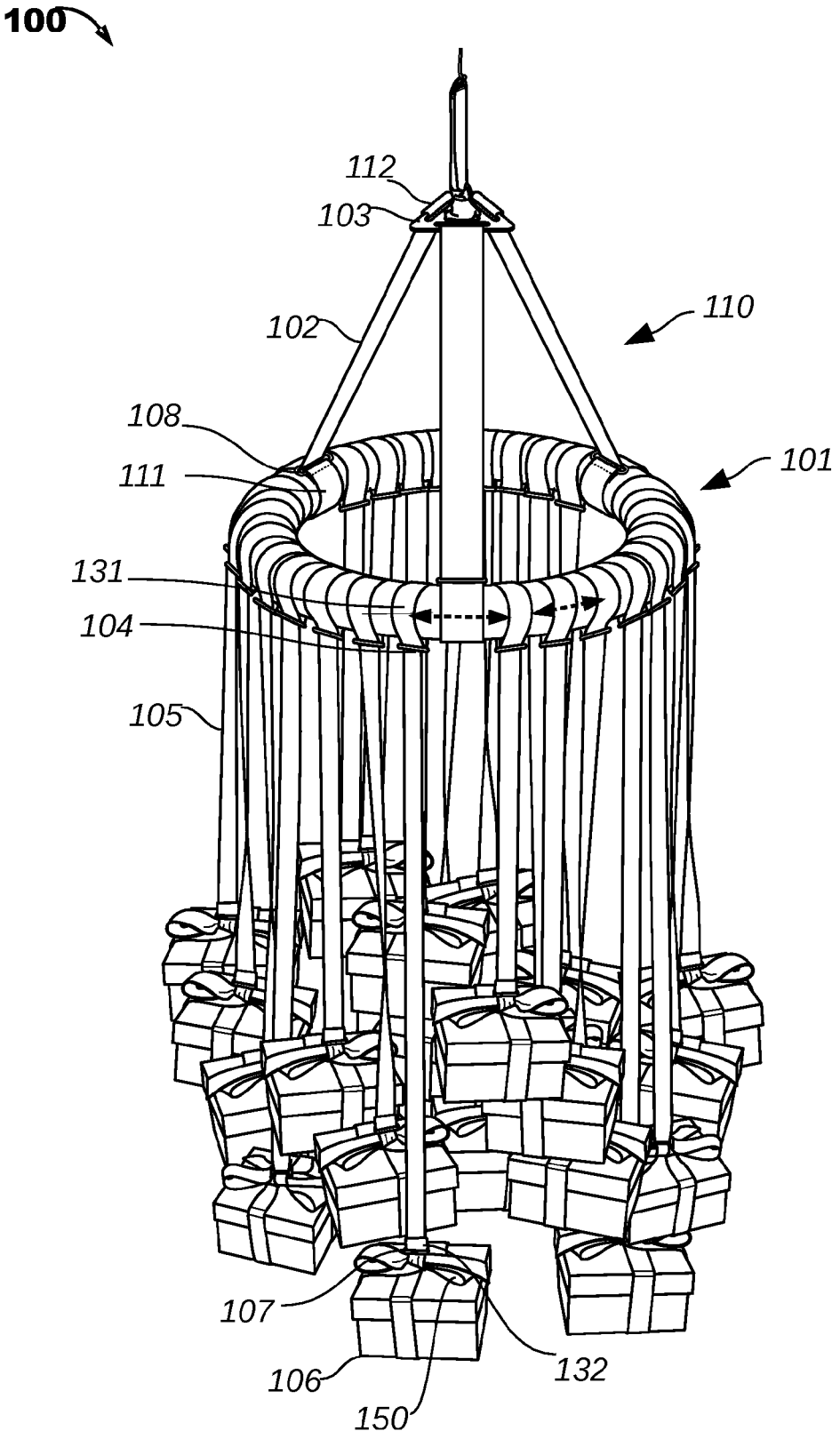
FIG. 1 illustrates a perspective view of a party gift wreath apparatus according to one embodiment.

In the following description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details. Note that in FIGS. 1-6, identical or similar parts are generally indicated by identical reference numerals.

Technical features described in this application can be used to construct various embodiments of gift wreath apparatus and methods. In one approach, a gift wreath apparatus hangs similar or different reusable gift boxes to be filled. Each gift box will stay ribbon tied until the removal of the box by means of a hook. All pieces are reusable and are designed for easy assembly. All hanging materials are secured by rings that are adjustable enabling the wreath shape to maintain balance. By way of example, the wreath apparatus has a wreath member for attaching to a support structure; a plurality of reusable gift boxes for filling with at least one gift, and a plurality of hangers for hanging the reusable gift boxes from the wreath member; each hanger including a first end for hanging from the wreath member and a second end for hanging one of the reusable gift boxes therefrom; a plurality of fasteners; each fastener being configured for attaching one of the reusable gift boxes in a substantially closed configuration to one of the hanger second ends and for detaching the gift box from the second hanger end; wherein each reusable gift box hanging from the wreath member is detachable from the hanger for filling with at least one gift, or removing a gift stored therein;

and wherein the detached reusable gift box is re-hangable from the wreath member in the substantially closed configuration by the fastener.

Referring to FIG. 1 of the accompanying drawings, there is illustrated a perspective view of a gift wreath apparatus according to one embodiment. In this particular example, gift wreath apparatus 100 is a party gift wreath that is reusable for celebrating any particular occasion, celebration or party idea, such as, a Birthday, Christmas, Valentines Day, or other occasion. A wreath member 101 is provided for hanging a plurality of reusable gift boxes 106 therefrom. The wreath member is attachable to a support structure (not shown). The support structure can be any type of existing or new structure which is capable of supporting the wreath member apparatus in a hanging position at a height that is sufficient to allow the gift wreath apparatus 100 to hang in an operable position, as shown in FIG. 1, above the ground or floor. Examples of such a support structure are a ceiling or wall mounted hook.

A plurality of hangers 105 hang the reusable gift boxes 106 from the wreath member 101. Each hanger 105 includes a first end 131 attached to the wreath member 101, and a second end 132 for hanging the reusable gift box 106 therefrom. A plurality of fasteners are configured for attaching and detaching the reusable gift boxes 106 in a substantially closed configuration, with or without a gift stored therein, to the hanger second end 132. In this manner, each reusable gift box can be detached from the hanger for filling with a gift, or removing a gift stored therein, and re-hung from the wreath member in the substantially closed configuration. The wreath apparatus allows users to easily fill and remove gifts from the gift boxes hanging on the wreath in a unique, convenient and easier manner and the apparatus is easily storable for future reuse. The apparatus also provides users with an unusual and creative way to exchange or offer gifts and favors. All party occasions are adaptable to the product with different flavors, such as for example birthdays, weddings, baby showers, graduations and fund raisers.

In this particular embodiment, wreath member is a ring member 101. Ring member 101 is a circular ring member as shown in FIG. 1 and is of circular cross-section. In alternative examples, wreath member is an oval, square, rectangular or other shaped ring of circular or other shaped cross-section. The wreath ring member 101 is manufactured from Styrofoam or other suitably rigid material for supporting the hanging reusable gift boxes 106. In the example of FIG. 1, hanging mechanism 110 is configured to operatively hang the wreath ring member 101 from the support structure (not shown) with the wreath ring member positioned in the substantially horizontal plane. Alternatively, the wreath ring member can be attached directly to the support structure.

Hanging mechanism 110 has a support plate 103 and a plurality of support ribbons 102. In alternative examples, strips, such as string, cord or other material can be employed instead of ribbons. In the example of FIG. 1, support plate 103 is a top metal piece that catches 3 support ribbons 102 which suspend the wreath ring member 101. Each support ribbon 102 has a first end 111 and a second end 112. Support ribbon first end 111 is looped or wrapped around the circumference of part of the circular ring wreath member 101 as shown in FIG. 1. Support ribbon second end 112 is pulled through a first elongated ring 108 (see FIG. 8) fixed to first end 111 so as to buckle or fasten the first end to the wreath member 101. The support ribbon is slideable circumferentially around the wreath ring member whilst in the normal hanging configuration or by loosening and moving the first end 111 around the wreath ring member. In this manner, each support ribbon 102 is removeably mounted to wreath ring member 101 and slidable circumferentially in a substantially horizontal plane around the wreath ring member 101 (see dotted arrows in FIG. 1). In the example of FIG. 1, first elongated rings 108 are oval metal hardware pieces that are for example 1.5"×3/16", securing the supporting ribbons allowing them to be adjustable for balance. In other examples, rings 108 are made of other suitably strong and rigid material such as a plastic.

Figure 3:
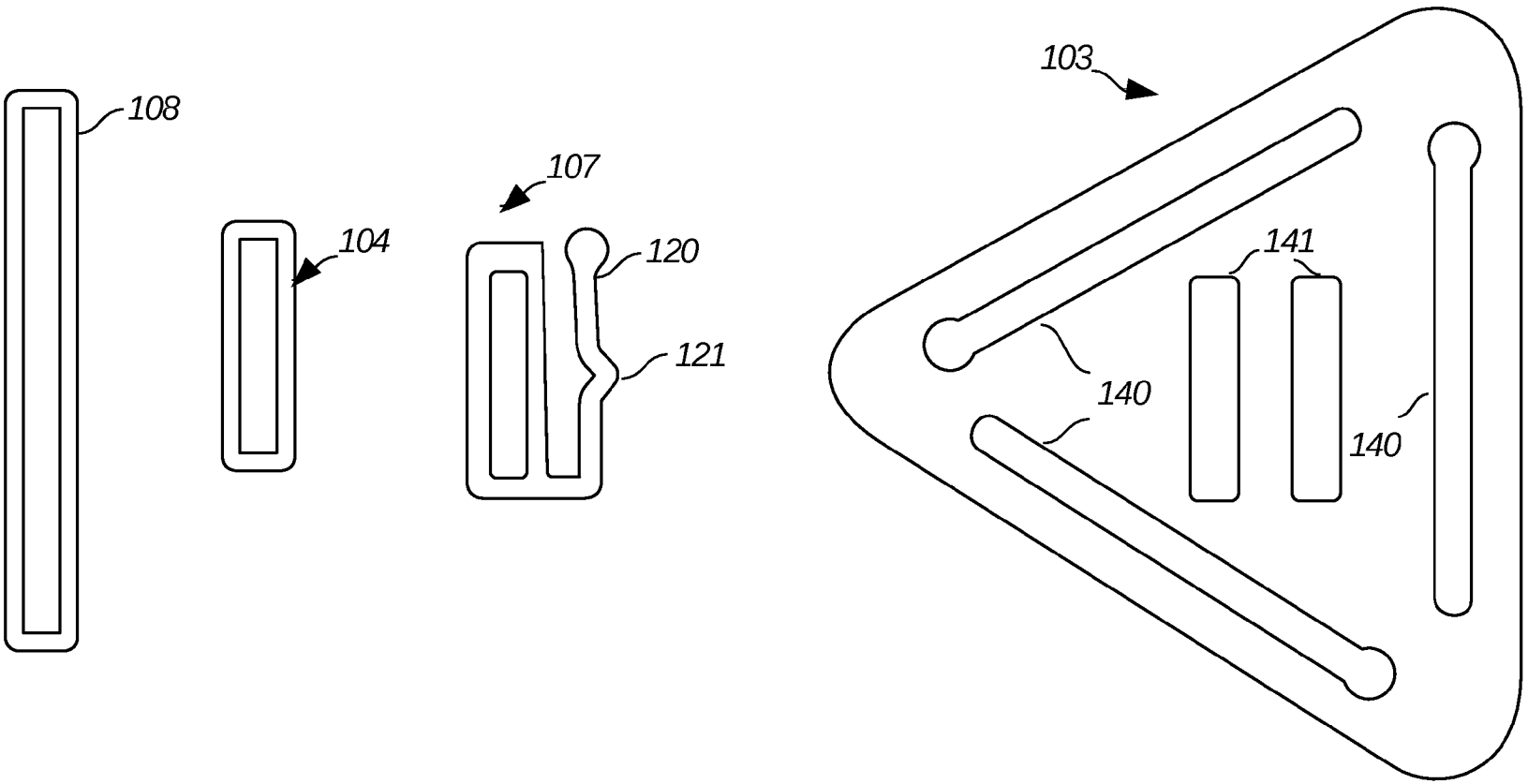
FIG. 3 illustrates a plan view of each type of metal hardware utilized in the wreath apparatus of FIG. 1.

In the example of FIG. 1, support plate 103 is a rectangular support plate that has three spaced apart slits 140. An example of such a support plate 103 is shown in FIG. 3. Each slit 140 extends substantially parallel with a respective edge of the rectangular plate to allow each support ribbon second end 112 to be sewn or otherwise fixed to a respective side of the rectangular plate. Other shaped support plates and other suitably positioned slits may be used to provide appropriate fixings for more support ribbons and/or alternative fixing configurations. Rectangular plate 112 has two spaced apart substantially parallel slits 1141 centrally located through which a ribbon is threaded to hang the rectangular plate from the support structure. Support ribbons 102 are spaced apart circumferentially around the wreath ring member 101 by sliding their first ends 111 to balance the wreath ring member 102 in the substantially horizontal plane. In another example, each support ribbon second end 112 is removeably attached to the support plate so that the hanging mechanism can be easily dissembled from the wreath member by detaching second ends 112 from the support plate and unthreading through rings 108 to allow the support ribbons 102 to be unraveled and detached from the wreath ring member 102.

Figure 2:
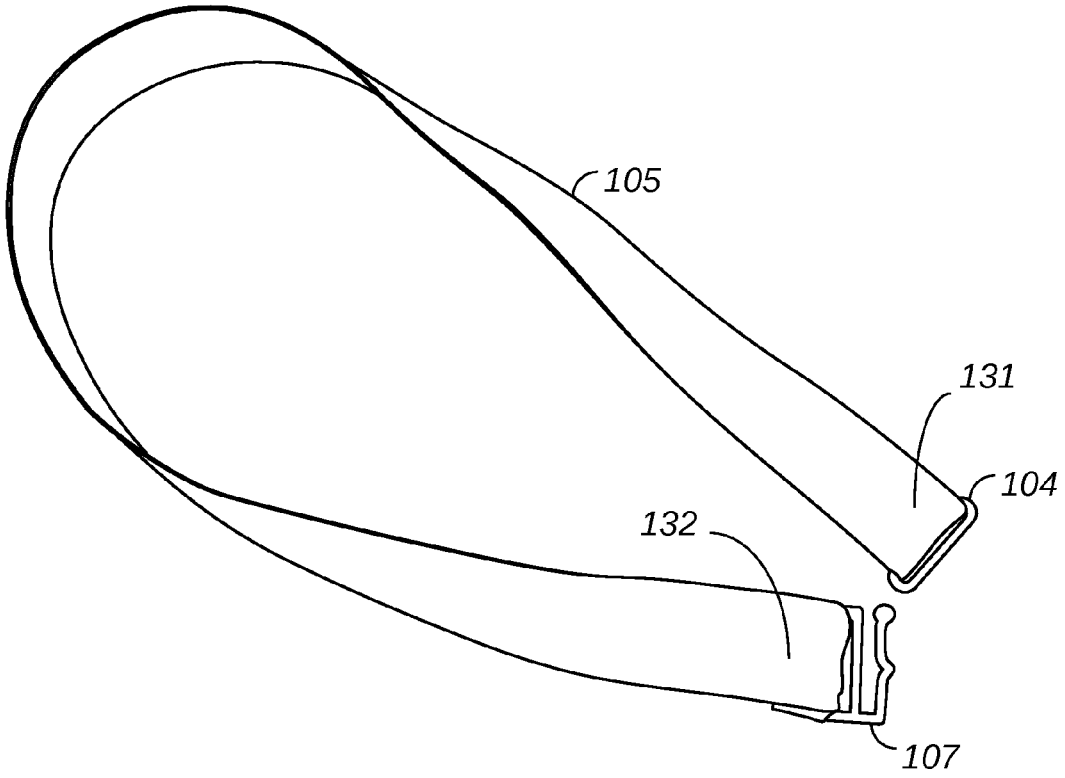
FIG. 2 is ribbon hanger and associated hardware according to an embodiment for attaching to the wreath ring member shown in FIG. 1.

Referring now in more detail to the plurality of hangers 105, in FIG. 1 each hanger is a ribbon 105 that hangs substantially vertically from the wreath ring member 102. In other examples, strips of material other than ribbons may be utilized. These hanger ribbons 105 are removeably and slidably attached to the wreath ring member 102 in a similar manner to the support ribbons. FIG. 2 is a perspective view of one of the hangers 105 for hanging from the wreath member. Hanger first end 131 is wrapped around part of ring member 102 and hanger second end 132 pulled through a metal ring 104 fixed to first end 131 to slidably and removeably secure first 131 end to wreath ring member 102. An example of ring 104 is shown in FIG. 3. Ribbon 105 is slidable circumferentially around the wreath ring member either in its normal hanging position or after first loosening the hanger first end 131 to allow the first end to move more freely around the wreath ring member. Hanger ribbon 105 is removeable by unthreading second end 132 through the first end metal ring 104 and unraveling the first end from the wreath member.

Some or all of the hanger ribbons 105 may be the same or different lengths depending on the application. In the example of FIG. 1, these ribbons 105 are narrower, for example, 5/8th", than support ribbons 102 but can be other widths. The number of hanging ribbons 105 will depend on the number of gifts or favors being given. For the Advent Wreath there are 24 boxes that represent the 24 days before Christmas.

Removeably and slidably attaching each ribbon hanger 105 to wreath ring member 102 permits easy, selective, rearrangement of different ribbons 105, and any gift boxes hanging thereon, on the wreath member. The hanging ribbons, and reusable gift boxes hanging therefrom, can be circumferentially distributed about the wreath ring member for balance, and as desired by the user to adapt the wreath apparatus to provide a specific gift wreath decorative "look and feel". Easy removal of the hanger ribbons from the wreath member also facilitates quick and simple disassembly and storage of the wreath apparatus.

Figure 4:
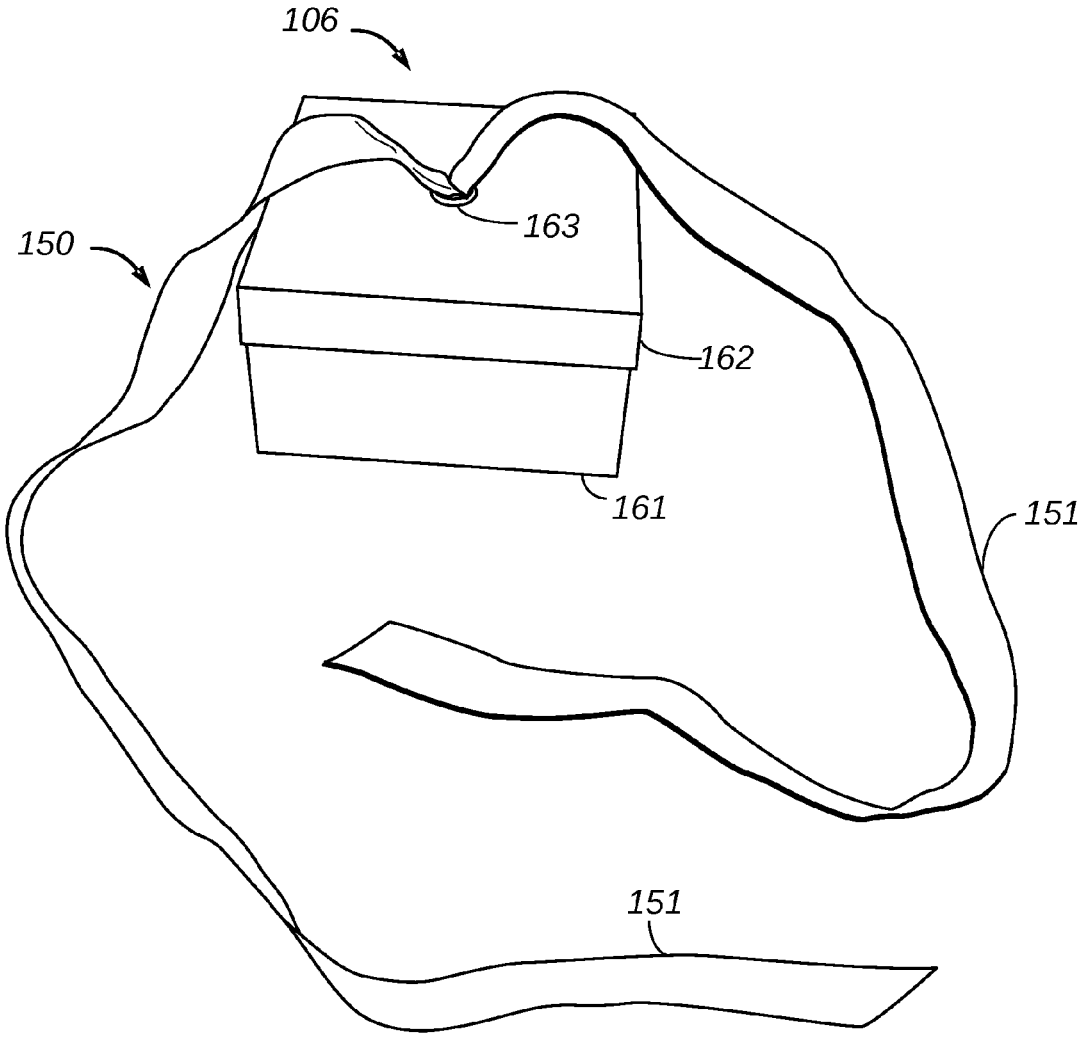
FIG. 4 illustrates a perspective view of a reusable gift box showing ribbon protruding out of the lid eyelet et ready for tying according to one embodiment.

Referring to now to the plurality of reusable gift boxes 106, the boxes can be identical or of different sizes and styles to suit the particular wreath application. Each reusable gift box 106 is configurable between an open configuration for removeably placing at least one gift therein and a closed configuration for storing one or more gift(s) inside the gift box. In the embodiment of FIG. 1, gift box 106 has a lid 162 and a compartment 161 (as best shown in FIG. 4). Lid 162 is configured to be removeably attached to compartment 161. As will be explained in more detail below, when the gift box is hanging from the wreath ring member, the lid and compartment are held together by the fastener system that enables the gift box to be attached an detached from the hanger ribbon.

Each of the plurality of fasteners is a hook and strip of material. The hook is fixed to the hanger second end and the strip of material is tied around the reusable gift box for keeping the gift box closed and attaching and detaching from the hook. As best shown in FIGS. 2 and 3, hook 120 is a multi-functional hook for either hanging the reusable gift box or an ornament from the hanger ribbon. This is beneficial for particular applications such as when the wreath apparatus serves as an Advent Wreath. Hook 120 can be fixed to hanger ribbon second end 132 in different ways. In the example of FIG. 1, at each of the hanger ribbon second ends 132 there is again an oval metal hardware ring sewn to the ribbon end but this hardware has an extra bar 120 that is attached at one end to the side of the ring 107 and extends longitudinally and substantially horizontally when the hanging ribbons are in the hanging position on the wreath member (see in particular FIGS. 1-3). A notch 121 is formed in the bar for facilitating hanging of an ornament instead of the reusable gift box from the hook.

In the example of FIG. 1, the strip of material tied about each reusable gift box 106 is a long ribbon 150. A section of the ribbon located about the middle of the ribbon length is secured about a central area of the lid such that the ribbon remains attached to the box and the free ends 151 are readily available (see FIG. 4).

A generally middle section of the ribbon is locatable generally centrally about the lid in different ways. In the example of FIG. 4, an eyelet 163 is punched in lid 162 from which the long ribbon protrudes and which has been secured on the inside. The box ribbon is long enough to wrap the box on all sides and tie a bow on top. The "bow tied" box can then be hung from the metal hook 120 and taken off the hook and still remain "bow tied" for the receiver of the gift box to untie to open the box.

Figure 6:
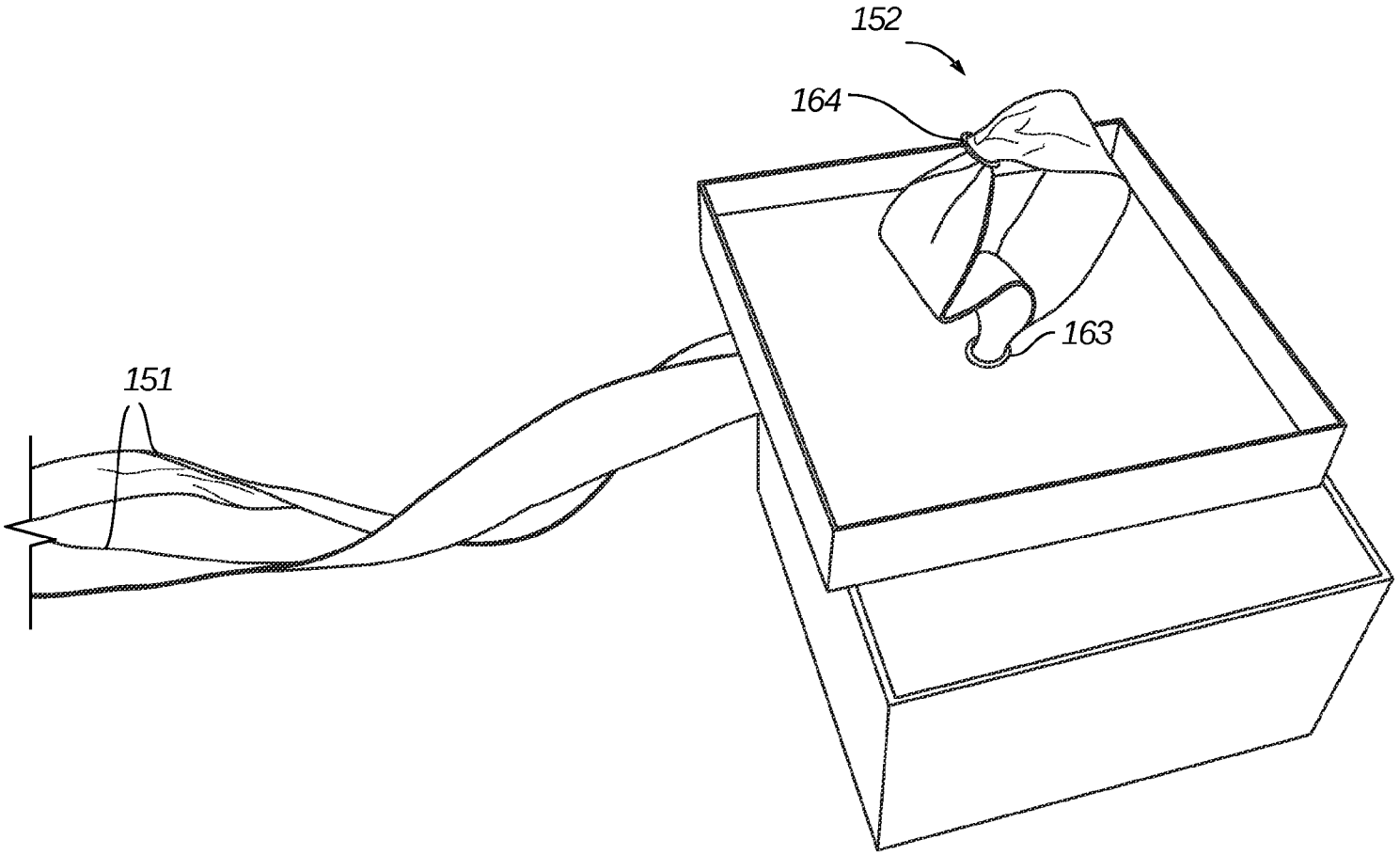
FIG. 6 is perspective view of the reusable gift box of FIG. 4 open showing the underside of the lid and folded ribbon ready for securing to the lid according to one embodiment.

In one example, the long ribbon is secured on the lid inside by a metal oval ring 164. As shown in FIG. 6, the ribbon middle section is substantially or partially folded width ways and the free ends of the folded ribbon are threaded through the lid eye let 163 and pulled such that the ribbon fold 152 and ring 164 threaded thereon are located securely on the underside of the lid.

Figure 5:
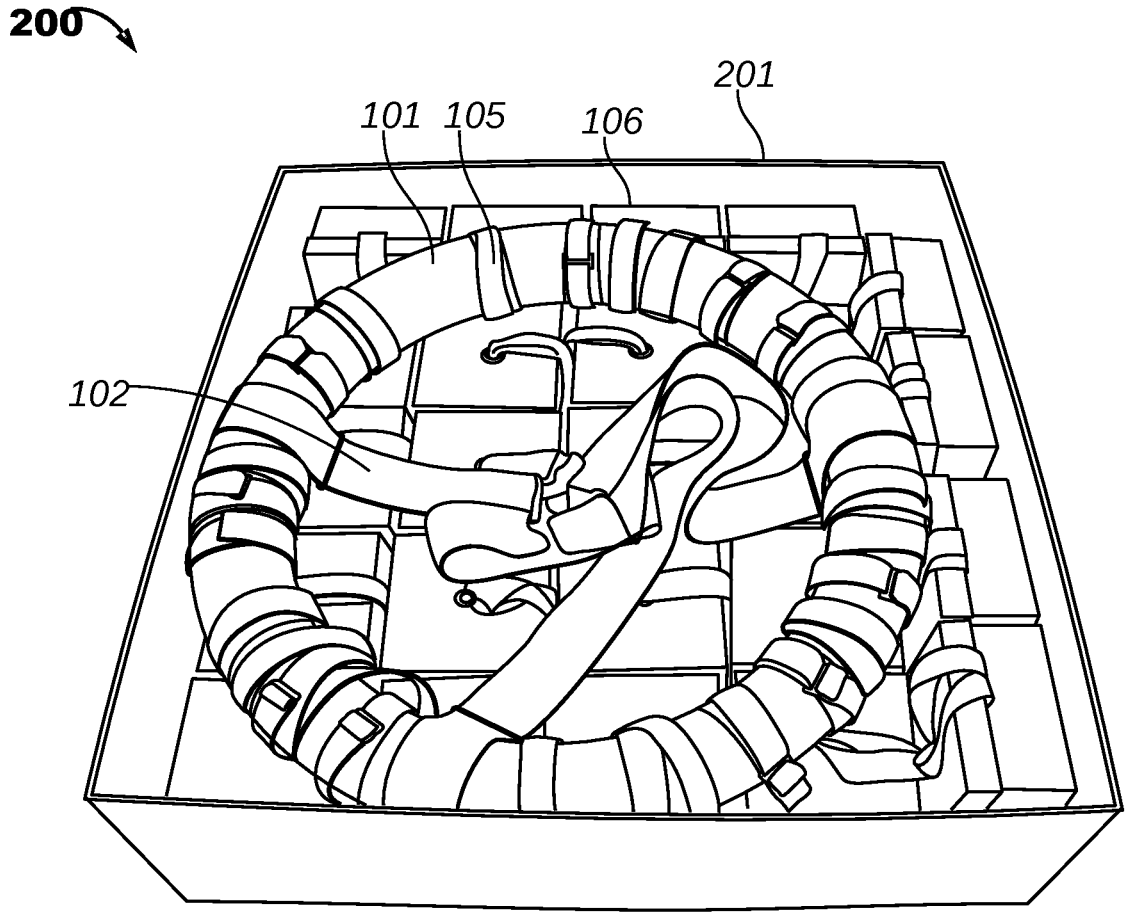
FIG. 5 is a perspective view of a kit of parts for assembling the wreath apparatus of FIG. 1 according to one embodiment.

According to one embodiment, the wreath apparatus of FIG. 1 can be provided as kit of parts 200 for assembly by the user. In one example, the kit of parts 200 is provided in a box 201, as shown in FIG. 5, and includes an instruction manual (not shown) for instructing the user on how to assemble and disassemble the wreath apparatus. The kit of parts can comprise or include the wreath member 101 for attaching to a support structure; the plurality of reusable gift boxes 106, the plurality of hanger ribbons 105, and the plurality of fasteners 120, 150. The apparatus is assembled by attaching the wreath member 102 to a support structure using for example the hanging mechanism 110 in the manner described above. First ends of each hanger 131 are then slidably and removeably attached to the wreath member ring. For each gift box, the box ribbon 150 is secured to the box lid 162 and the ribbon bow towed to hold the lid closed. Hook 120 secured to the hanger ribbon second end 132 is then hooked underneath part of the ribbon bow tie knot to removeably hang the reusable box to the wreath ring member. The gift box can then be removed from the hook on the hanger second end with the bow tie still remaining on the gift box ready for opening the box. An ornament can be hung on the hook in place of the gift box.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

What is claimed is:

1. A wreath apparatus comprising a wreath member for attaching to a support structure;

a plurality of reusable gift boxes for filling with at least one gift, a plurality of hangers for hanging the reusable gift boxes from the wreath member; each hanger including a first end for hanging from said wreath member and a second end for hanging one of the reusable gift boxes therefrom;

a plurality of fasteners; each fastener being configured for attaching one of the reusable gift boxes in a substantially closed configuration to one of the hanger second ends and for detaching the gift box from said second hanger end;

wherein each reusable gift box hanging from the wreath member is detachable from the hanger for filling with at least one gift, or removing a gift stored therein; and wherein the detached reusable gift box is re-hangable from the wreath member in the substantially closed configuration by the fastener.

2. The apparatus of claim 1, wherein each hanger comprises a strip of material hanging substantially vertically from said wreath member.

3. The apparatus of claim 2, wherein said wreath member comprises a ring member for attaching to a support structure such that said ring member occupies a substantially horizontal plane, and wherein each hanger first end is slidably attached to said ring member such that the hanging position of each hanger is adjustable circumferentially along the ring member.

4. The apparatus of claim 1, wherein each hanger first end is removeably attached to the wreath member.

5. The apparatus of claim 2, wherein said strip of material comprises a ribbon.

6. The apparatus of claim 4, wherein the hanger ribbon first end is wrapped around part of said ring wreath member and said second end threaded through a ring fixed to said first end to thereby fasten said first end to said wreath ring member such that the hanger first end is removeably attached to said wreath member and slidable circumferentially along the ring member.

7. The apparatus of claim 1, wherein each fastener comprises a hook fixed to the second end of the hanger and a strip of material attached to said reusable gift box, wherein said strip of material is configured to maintain the reusable gift box in a substantially closed configuration in which a lid and compartment of the box are held closed together and wherein said strip of material is further configured to be hangable from said hook.

8. The apparatus of claim 7, wherein said hook is a multifunctional hook and includes a notch for hanging an ornament in place of said reusable gift box.

9. The apparatus of claim 7, wherein said strip of flexible material attached to said reusable gift box comprises a length of ribbon; wherein a section of the ribbon located about the middle of the ribbon length is secured about a central area of the lid; and wherein the ribbon is wrapped around the lid and compartment and bow tied together about the lid such that the ribbon holds the compartment and lid together in the closed configuration and the gift box is hangable from the hook on the bow tow and removeable from the hook with the bow tied on the gift box.

10. The apparatus of claim 9, wherein said ribbon section is substantially or partially folded width ways; wherein said lid has an eyelet formed therein for feeding the free ends of the folded ribbon therethrough such that the ribbon fold is located on the underside of the lid and the remaining ribbon protrudes through the eyelet and out of the upperside of the lid; and wherein said ribbon fold is removeably located beneath the lid by a ring threaded on the ribbon fold, said threaded ring being configured to abut the underside of the lid and secure the folded ribbon section to the lid when the ribbon protruding from the eyelet is bow tied on the outside of the lid.

11. The apparatus of claim 1, further comprising a hanging mechanism operatively coupled to the wreath ring member for hanging the wreath ring member from said support structure in a substantially horizontal plane, wherein said hanging mechanism comprises a support plate and a plurality of support strips of flexible material; wherein each strip of flexible material has a first end and a second end, wherein said first end is removeably and slidably attached to said wreath ring member and wherein said second end is attached to said support plate for hanging said wreath member from said support plate and wherein said first ends of said plurality of strips of material are slidably distributed about said wreath ring member so as to hang, from said support plate, said wreath ring member in said substantially horizontal plane.

12. A kit of parts for assembling a wreath apparatus, the kit of parts comprising a wreath member for attaching to a support structure;

a plurality of reusable gift boxes for filling with at least one gift, a plurality of hangers for hanging the reusable gift boxes from the wreath member; each hanger including a first end for hanging from said wreath member and a second end for hanging one of the reusable gift boxes therefrom;

a plurality of fasteners; each fastener being configured for attaching one of the reusable gift boxes in a substantially closed configuration to one of the hanger second ends and for detaching the gift box from said second hanger end;

wherein, on assembly, each resusable gift box hanging from the wreath member is detachable from the hanger for filling with at least one gift, or removing a gift stored therein; and wherein the detached reusable gift box is re-hangable from the wreath member in the substantially closed configuration by the fastener.

13. The kit of parts of claim 12, wherein each hanger comprises a strip of material hanging substantially vertically from said wreath member;

wherein said wreath member comprises a wreath ring member for attaching to a support structure such that said ring member occupies a substantially horizontal plane, wherein each hanger first end is slidably attachable to said ring member such that the hanging position of each hanger is adjustable circumferentially along the wreath ring member; and wherein each hanger is removeably attachable to the wreath ring member.

14. The kit of parts of claim 13, wherein said strip of material comprises a ribbon.

15. The kit of parts of claim 14, wherein said fastener comprises a hook fixed to the second end of said hanger and a length of ribbon; wherein a ribbon section located about the middle of the ribbon length is secured about a central area of the lid and wherein free ends of the secured ribbon are wrapped around the lid and compartment and bow tied together about the lid such that the ribbon holds the compartment and lid together in the closed configuration whilst the gift box is hanging from the hook and such that the bow tie remains on the gift box when the gift box is detached from the hook.

16. The kit of parts of claim 15, wherein said hook is a multifunctional hook including a notch for hanging an ornament in place of said reusable gift box.

17. The kit of parts of claim 13, further comprising a box and an instruction manual for assembling said wreath apparatus from said kit of parts; wherein said wreath member, said plurality of reusable gift boxes; said plurality of hanger; said plurality of fasteners; and said instruction manual are carried in said box.

18. A method for assembling a wreath apparatus, said wreath apparatus comprising a wreath member for attaching to a support structure, a plurality of reusable gift boxes for filling with at least one gift, a plurality of hangers for hanging the reusable gift boxes from the wreath member, each hanger including a first end for hanging from said wreath member and a second end for hanging one of the reusable gift boxes therefrom, and a plurality of fasteners; each fastener being configured for attaching one of the reusable gift boxes in a substantially closed configuration to one of the hanger second ends and for detaching the gift box from said second hanger end; the method for assembly comprising attaching the wreath member to the support structure;

hanging a first end of each hanger from said wreath member; and utilizing each fastener to hang each reusable gift box from the second end of each hanger whilst holding the gift box closed;

utilizing each fastener to remove the gift box from the hanger second end whilst holding the gift box closed.

19. The method of claim 18, wherein the plurality of hangers comprise a plurality of ribbons; wherein attaching the wreath member to a support structure comprises hanging the wreath member from the wreath member such that said ring member occupies a substantially horizontal plane; and wherein hanging each ribbon from said wreath member comprises slidably and removeably attaching each first end of the ribbon hanger to said ring member such that the hanger hangs substantially vertically for the wreath ring member and is moveable circumferentially along the ring member and removeably therefrom.

20. The method of claim 18, further comprising assembling said wreath apparatus according to an instructions manual.

* * * * *